US007320462B2

(12) United States Patent
Takamatsu

(10) Patent No.: US 7,320,462 B2
(45) Date of Patent: Jan. 22, 2008

(54) AUTOMATIC DOCUMENT TRANSPORTATION DEVICE

(75) Inventor: Naritoshi Takamatsu, Nara (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 374 days.

(21) Appl. No.: 10/967,825

(22) Filed: Oct. 18, 2004

(65) Prior Publication Data

US 2005/0087920 A1 Apr. 28, 2005

(30) Foreign Application Priority Data

Oct. 24, 2003 (JP) ..... 2003-364209

(51) Int. Cl.
*B65H 5/22* (2006.01)

(52) U.S. Cl. ..... 271/3.14; 271/4.1; 271/10.11; 271/117; 399/380

(58) Field of Classification Search ..... 271/3.14, 271/3.15, 3.17, 4.01, 4.08, 4.1, 10.01, 10.09, 271/10.11, 117, 118, 273; 399/367, 380
See application file for complete search history.

(56) References Cited

U.S. PATENT DOCUMENTS

| | | | | |
|---|---|---|---|---|
| 4,861,012 | A * | 8/1989 | Shimizu | 271/3.02 |
| 4,917,368 | A * | 4/1990 | LaBelle et al. | 271/21 |
| 5,064,182 | A * | 11/1991 | Tokutsu | 271/3.17 |
| 5,732,321 | A * | 3/1998 | Ishizuka et al. | 399/391 |
| 5,971,388 | A * | 10/1999 | Hattori et al. | 271/10.03 |
| 6,431,541 | B2 * | 8/2002 | Kuo et al. | 271/118 |
| 6,547,235 | B2 * | 4/2003 | Higaki | 271/10.01 |
| 6,792,241 | B2 * | 9/2004 | Nakagawa et al. | 399/367 |
| 6,991,227 | B2 * | 1/2006 | Kim | 271/10.12 |
| 2004/0071486 | A1 * | 4/2004 | Manabe et al. | 399/367 |
| 2005/0035524 | A1 * | 2/2005 | Fukumura et al. | 271/4.1 |

FOREIGN PATENT DOCUMENTS

| | | |
|---|---|---|
| JP | 01-194658 | 8/1989 |
| JP | 05-043076 | 2/1993 |
| JP | 2001-039603 | 2/2001 |
| JP | 2002-220122 | 8/2002 |
| JP | 2002255363 A * | 9/2002 |

OTHER PUBLICATIONS

Chinese language office action and its English translation for corresponding Chinese application No. 200410085937X lists the references above.

* cited by examiner

*Primary Examiner*—Patrick Mackey
*Assistant Examiner*—Michael C McCullough
(74) *Attorney, Agent, or Firm*—Hogan & Hartson LLP

(57) ABSTRACT

An automatic document transportation device includes a shutter, a stopper and a shutter releasing mechanism. The shutter is provided at upstream of a document feed roller and suspended from a cover under a freely swinging state. The stopper is provided on a pickup arm, stops a swing of the shutter so that the shutter restricts a position of a leading edge of an original document on a document tray when the pickup arm is under a standby state, and releases the stop of the shutter when the pickup arm operates in a direction to make contact with the original document. The shutter releasing mechanism moves the pickup arm under the standby state in the direction to make contact with the original document.

12 Claims, 13 Drawing Sheets

AUTOMATIC DOCUMENT TRANSPORTATION DEVICE

BACKGROUND OF THE INVENTION

1. Field of the Invention

The present invention relates to an automatic document transportation device in a scanner, a facsimile machine and a copy machine or the like, which transports an original document on a document tray through a transportation path to a scanning position and a document discharge tray.

2. Description of the Related Art

A scanner, a facsimile machine and a copy machine or the like each includes an automatic document transportation device having an Automatic Document Feeder (ADF) which sequentially feeds a plurality of original documents. By using the automatic document transportation device, a plurality of original documents placed on a document tray can be transported continuously and automatically to a scanning position.

FIG. 12 is a schematic perspective view showing an exterior of a copy-and-facsimile Multi Function Peripheral (MFP) 900 having the ADF. As shown in the drawing, the copy-and-facsimile MFP 900 includes a scanning table 901, a document pressing cover 902, an operation panel 903, a frame 904 and paper feed cassettes 905. The scanning table 901 includes a platen glass on which an original document to be scanned is placed. The document pressing cover 902 presses and fixes the original document on the platen glass. The operation panel 903 is used for, for example, inputting a start of a scanning process of the original document. The frame 904 includes an image printing unit which prints an image onto recording paper and a transmission unit which electrically transmits the image, or the like. The paper feed cassettes 905 feed recording papers for printing the scanned image. In the copy-and-facsimile MFP 900, the automatic document transportation device is formed by the ADF in the document pressing cover 902. An original document on a document tray 906 is transported by the ADF from the document tray 906 to a document discharge tray 907 provided below the document tray 906, from an upper side to a lower side in a U-turn manner. In the transportation process, when the original document passes the scanning position on the platen glass, an image of the original document is scanned by the image scanning unit such as a Charge Coupled Device (CCD) provided in the scanning table 901.

FIG. 13 is a cross-sectional view showing a schematic configuration of the document pressing cover 902 of the copy-and-facsimile MFP 900. As shown in the drawing, a transportation path 908 is formed from the document tray 906 via an image scanning surface to the document discharge tray 907. The original documents on the document tray 906 are transported continuously to the document discharge tray 907 by a document feed roller 909 provided in proximity to an inlet of the transportation path 908 and transportation rollers 910 provided appropriately along the transportation path 908. When the original document picked up from the document tray 906 and fed into the transportation path 908 passes a scanning position P1 in the transportation process, an image scanning process is executed on one side of the original document by a scanning unit 911 such as a CCD provided in the scanning table 901. At a scanning position P2 located downstream of the scanning position P1, an image scanning process is executed on another side of the original document by a scanning unit 912 such as a Contact Image Sensor (CIS) provided in the document pressing cover 902.

In the above-described copy-and-facsimile MFP 900, when a user places an original document on the document tray 906 vigorously in a direction toward the transportation path 908, there are cases in which a leading edge of the original document collides against the document feed roller 909 and the original document is damaged. There are also cases in which leading edges of a plurality of original documents are caught by the document feed roller 909 and a multi-feeding is generated. To prevent such failures, there is a proposal made to provide a shutter 913 upstream of the document feed roller 909 in a manner that the shutter 913 can protrude and recede. When placing an original document on the document tray 906, the shutter 913 protrudes to shut the transportation path 908 for preventing the original document from entering downstream of the shutter 913. When transporting the original document, the shutter 913 recedes to permit the original document to pass through the transportation path 908.

Meanwhile, in the above-described copy-and-facsimile MFP 900, for carrying out maintenance work and for removing jammed paper, a cover is provided so that a housing of the document pressing cover 902 can be opened and closed. However, when the shutter 913 is provided on the cover, in case the cover is opened with the shutter 913 protruding, the original documents on the document tray 906, which were restricted by the shutter 913, flow into the transportation path 908. Then, when the cover is closed, the shutter 913 thrusts into the original documents and the original documents are damaged.

SUMMARY OF THE INVENTION

The present invention has been made in consideration of the above-described drawbacks. An advantage of the present invention is to provide a means for preventing an original document from being damaged by a shutter, which is provided on a cover of an automatic document transportation device and restricts an entering position of the original document, when opening and closing the cover.

According to an aspect of the present invention, a main frame of an automatic document transportation device includes a document tray on which an original document before a scanning process is placed, transportation rollers which transport the original document through a transportation path, and a document discharge tray on which the original document after the scanning process is stacked. A cover is provided on an upper part of the main frame of the automatic document transportation device in a manner capable of being swung. The cover includes a pickup roller which picks up the original document from the document tray, a pickup arm which supports the pickup roller in a manner that the pickup roller can make contact with and separate from the original document on the document tray, and a document feed roller which feeds the picked up original document into the transportation path. The automatic document transportation device includes a shutter, a stopper and a shutter releasing mechanism. The shutter is located upstream of the document feed roller and is suspended under a freely swinging state from the cover. The stopper is provided on the pickup arm. When the pickup arm is under a standby state, the stopper stops the swing of the shutter so that the shutter restricts a position of a leading edge of the original document placed on the document tray. In addition, the stopper releases the stop of the shutter when the pickup arm operates in a direction to make contact with the original document. The shutter releasing mechanism moves the pickup arm under the standby state in the direction to make contact with the original document.

According to an aspect of the present invention, the shutter releasing mechanism includes a shaft and an operation knob. The shaft has a protrusion for moving the pickup arm in the direction to make contact with the original document. The operation knob rotates the shaft.

According to an aspect of the present invention, the automatic document transportation device includes a lock mechanism which locks the swing of the cover under a state in which the cover is covering the upper part of the main frame. The operation knob rotates the shaft and releases the locked state of the lock mechanism.

According to an aspect of the present invention, the cover is provided in a manner capable of being swung with a downstream side of a document transportation direction as a center of the swing. In addition, the stopper is provided protruding with respect to the swing of the shutter so as to stop the shutter at a position located to the center of the swing of the cover than a naturally suspended position. The automatic document transportation device further includes an open/close sensor and a control unit. The open/close sensor detects an opened or a closed state of the cover. The control unit receives from the open/close sensor, a signal indicating that the opened cover has been closed. Then, the control unit operates the pickup arm in the direction to make contact with the original document and puts the pickup arm into the standby state.

According to the present invention, by operating the shutter releasing mechanism, the stop of the shutter can be released and the shutter can be provided under the freely swinging state. Therefore, when closing the cover, the original document is not damaged by the shutter. Since the shutter releasing mechanism can be operated by the operation knob, the releasing operation can be carried out easily. Furthermore, since the locked state of the cover can be released by the operation knob, when opening the cover, the lock releasing operation of the lock mechanism and the operation of the shutter releasing mechanism can be carried out at the same time. Thus, operationality is improved even more.

According to the present invention, the open/close sensor of the cover is provided. When the cover is closed, in accordance with the output signal from the open/close sensor, the control unit operates the pickup arm in the direction to make contact with the original document and then the pickup arm is returned to the standby state. Therefore, the swing of the shutter, which the stopped state has been released when opening the cover, is stopped again by the stopper. Thus, after opening or closing the cover, the shutter automatically returns to the stopped state.

DETAILED DESCRIPTION OF THE PREFERRED EMBODIMENTS

Figure 1:
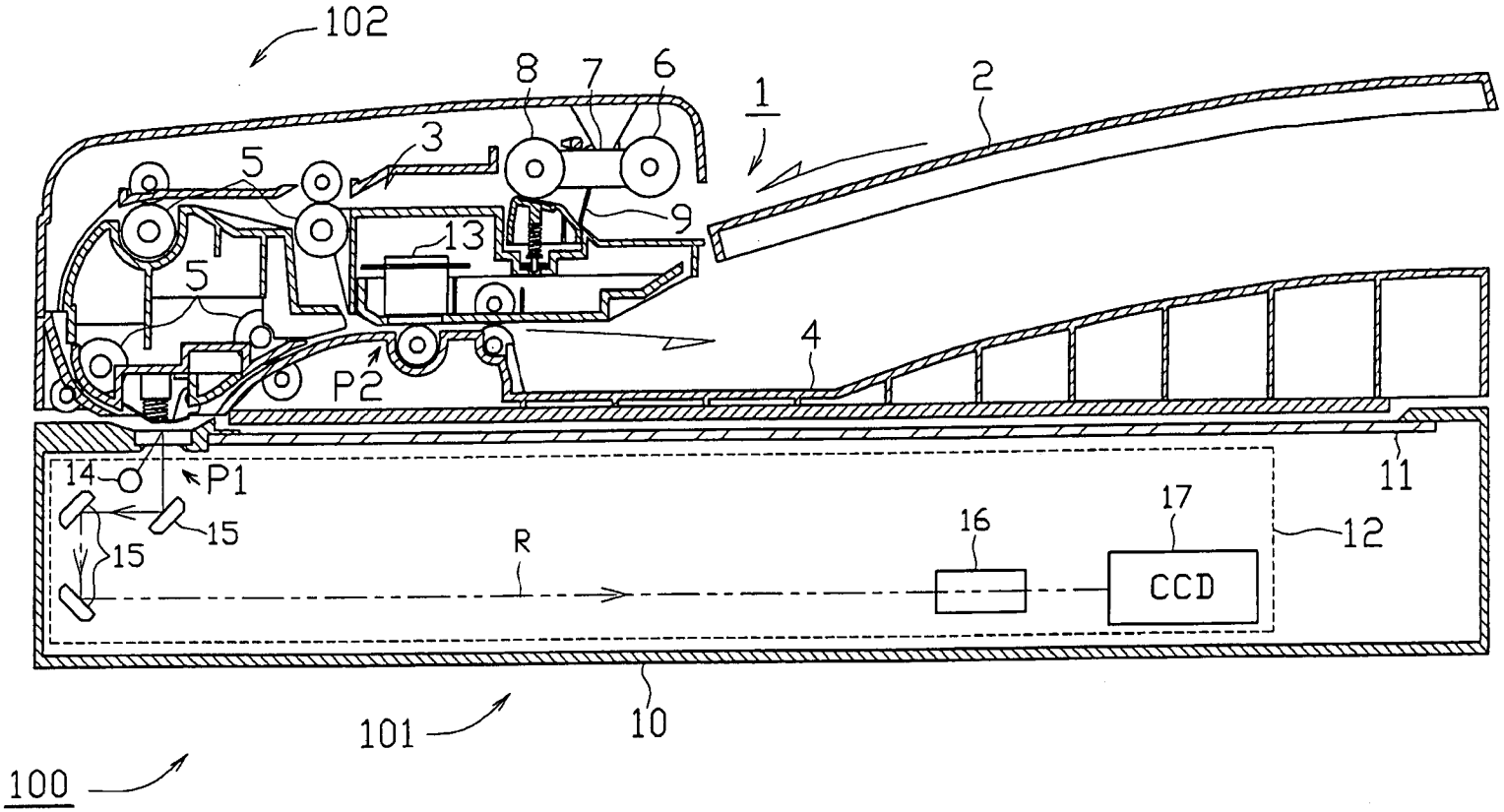
FIG. 1 is a cross-sectional view showing a schematic configuration of an upper part of a copy-and-facsimile MFP 100 according to an embodiment of the present invention.

FIG. 1 is a cross-sectional view showing an upper part of a copy-and-facsimile MFP 100 having an automatic document transportation device 1 according to an embodiment of the present invention. As shown in the drawing, in the copy-and-facsimile MFP 100, a document pressing cover 102 is supported axially on a scanning table 101 in a manner capable of being opened and closed. The scanning table 101 functions as a Flat Bed Scanner (FBS). Although not shown in the drawing, for example, the copy-and-facsimile MFP 100 includes a known configuration such as an operation panel for inputting a start of a scanning process of an original document or the like, an image printing unit for printing an image onto recording paper, a transmission unit for electrically transmitting the image and a paper feed cassette for feeding the recording paper to print out the scanned image. The known configuration is an example and can be provided optionally.

In the scanning table 101, a platen glass 11 is provided on an upper surface of an approximately rectangular parallelepiped housing 10. The housing 10 includes a CCD scanning unit 12. The CCD scanning unit 12 is a scanning unit of a so-called reduced optical system. As shown in FIG. 1, the CCD scanning unit 12 includes a light source 14, reflecting mirrors 15, a light-gathering lens 16 and a CCD 17. The light source 14 irradiates light to a scanning position P1. The reflecting mirrors 15 guide reflected light R from the original document to a prescribed direction. The light-gathering lens 16 focuses the reflected light R. The CCD 17 converts the focused light into an electric signal and outputs the electric signal. When the above-described CCD scanning unit 12 functions as the FBS, the CCD scanning unit 12 moves horizontally with respect to the platen glass 11 to scan the original document on the platen glass 11. When using the automatic document transportation device 1, the CCD scanning unit 12 moves to the scanning position P1 to scan an image of the original document transported through a transportation path 3. Then, the reflected light R from the original document is guided to the CCD 17 and an image is formed. Further, although not shown in the drawing, an analog-to-digital conversion and a shading process or the like are executed on an image signal which has been scanned by the CCD scanning unit 12 and converted into an electric signal. Then, the image signal is printed out onto the recording paper by the image printing unit such as a printer or transmitted electrically by a transmission unit such as a codec.

Figure 2:
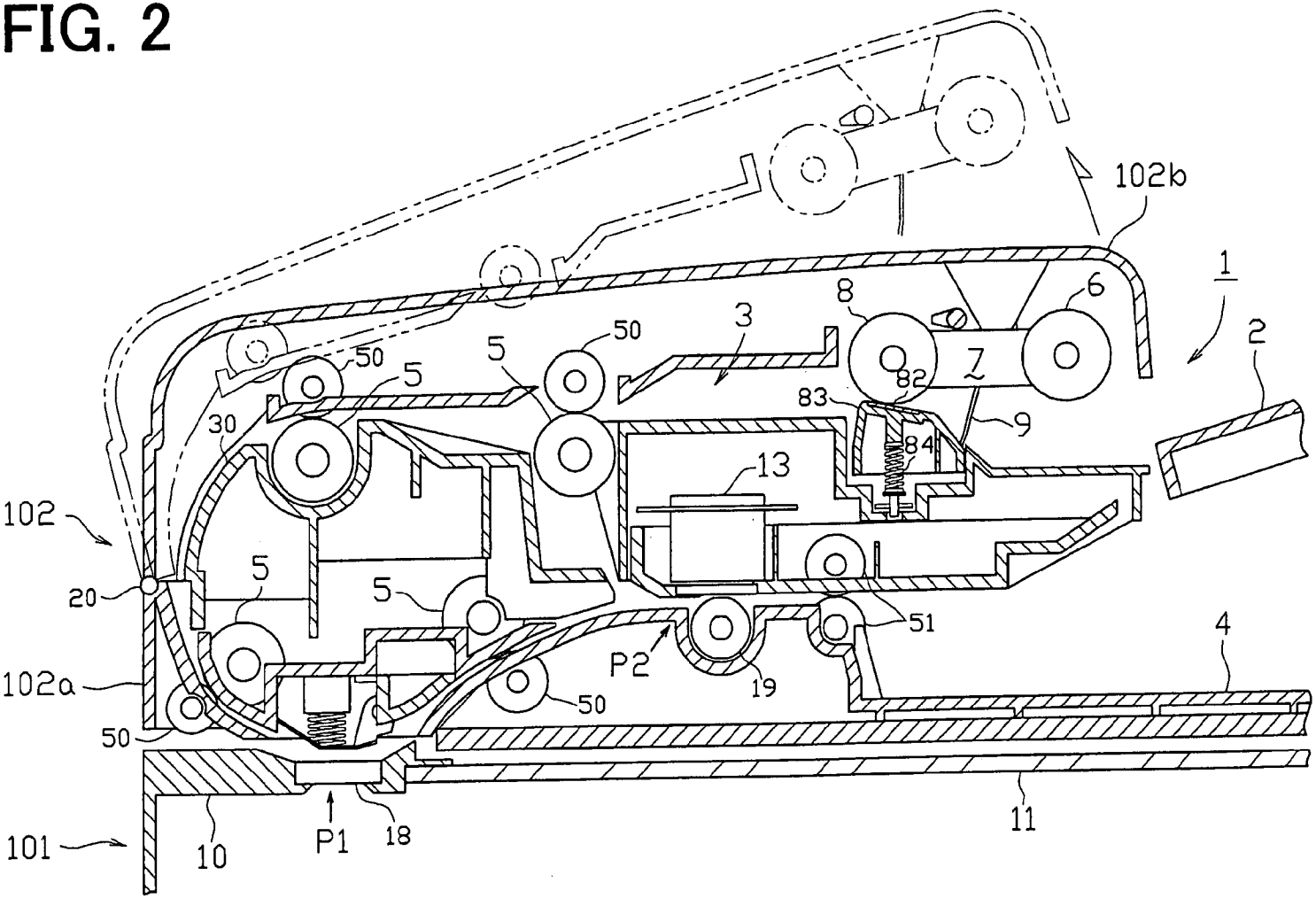
FIG. 2 is an enlarged cross-sectional view showing the schematic configuration of the upper part of the copy-and-facsimile MFP 100.

As shown in FIG. 2, the automatic document transportation device 1 is provided as an ADF inside the document pressing cover 102. The automatic document transportation device 1 continuously transports original documents to scanning positions P1 and P2. An original document on a document tray 2 is fed into the transportation path 3 by the automatic document transportation device 1. The original document is transported along the transportation path 3 having a sideways letter-U shape by being reversed so as to make a U-turn from an upper side to a lower side. Then, the original document reaches the scanning position P1. When the original document passes the scanning position P1, the CCD scanning unit 12 scans an image on a front side of the original document. The original document is transported further and reaches the scanning position P2. When the original document passes the scanning position P2, a CIS scanning unit 13 scans an image on a reverse side of the original document. Then, the original document is discharged onto a document discharge tray 4 located below the document tray 2. Further, the duplex scanning process for scanning both sides of the original document carried out by the copy-and-facsimile MFP 100 is an option, and of course, only a single-side scanning process for scanning a single side of the original document can be carried out.

In the document pressing cover 102, an ADF cover 102*b* is provided on an upper part of a cover frame 102*a* in a manner capable of being swung. On the cover frame 102*a*, the document tray 2, the transportation path 3 having the sideways letter-U shape, the document discharge tray 4, transportation rollers 5 and the CIS scanning unit 13 are provided. The document tray 2 carries a plurality of original documents under a stacked state. The document discharge tray 4 carries the transported original documents under a stacked state. The transportation rollers 5 nip and transport an original document through the transportation path 3. The CIS scanning unit 13 scans an image of the original document at the scanning position P2. On the ADF cover 102*b*, a pickup roller 6, a pickup arm 7, a document feed roller 8 and a shutter 9 are provided. The pickup roller 6 picks up an original document on the document tray 2. The pickup arm 7 supports the pickup roller 6 in a manner that the pickup roller 6 can make contact with and separate from the original document placed on the document tray 2. The document feed roller 8 feeds the picked up original document into the transportation path 3. The shutter 9 restricts a position of a leading edge of the original document upstream of the document feed roller 8.

The cover frame 102*a* is a housing of the document pressing cover 102. Each of the members of the automatic document transportation device 1 is mounted on the cover frame 102*a*. An outer guide surface of the transportation path 3 and the document discharge tray 4 are formed integrally with the cover frame 102*a*. Meanwhile, the ADF cover 102*b* mainly forms an upper part of the housing of the document pressing cover 102. The ADF cover 102*b* is provided on the cover frame 102*a* in a manner capable of being swung with a downstream side of a document transportation direction as a center of the swing. Specifically, as shown in FIG. 2, the ADF cover 102*b* constitutes a sidewall and a top plate of the document pressing cover 102 located on a side where the ADF, which is the automatic document transportation device 1, is provided. A lower end of the sidewall part of the ADF cover 102*b* is supported on the cover frame 102*a* via a spindle 20. Therefore, by lifting up an upstream side of the transportation direction of the ADF cover 102*b*, in other words, by lifting up a side of the ADF cover 102*b* located next to the document tray 2, the ADF cover 102*b* can be opened and closed with the spindle 20 as the center of the swing. By opening the ADF cover 102*b*, an inner configuration of the document pressing cover 102 such as the transportation path 3 and the transportation rollers 5 is exposed. Accordingly, maintenance work and removal of jammed paper can be carried out. A lower surface of the ADF cover 102*b* and the cover frame 102*a* constitute the outer guide surface of the transportation path 3.

At an upper part of the document pressing cover 102, the document tray 2 is provided slightly slanting toward a direction to feed the original document. On an upper surface of the document tray 2, a plurality of the original documents before the scanning process are stacked. In case a user places an original document on the document tray 2, the user places a leading edge of the original document at a lower end of the slanted document tray 2 so that the leading edge of the original document is inserted to the inlet of the transportation path 3. Further, although not shown in the drawing, a movable guide is provided on the document tray 2 for regulating a position of the original document in a width direction and preventing a skew of the original document.

The transportation path 3 is formed in the sideways letter-U shape from the document tray 2 to the document discharge tray 4. The transportation path 3 passes the platen glass 18 at the scanning position P1 directly downstream of the U-turn, passes the scanning position P2 at the downstream of the scanning position P1 and is connected to the document discharge tray 4. A paper guide 30 provided in the document pressing cover 102 forms an inner guide surface of the transportation path 3. The cover frame 102*a* and the ADF cover 102*b* of the document pressing cover 102 form an outer guide surface of the transportation path 3. Accordingly, an original document of a prescribed thickness can pass through the transportation path 3. Further, the outer guide member of the transportation path 3 is not limited to the cover frame 102*a* or the like shown in the present embodiment. Other forms can be adopted for the outer guide member of the transportation path 3 without departing from the scope of the present invention. If the cover frame 102*a* and the ADF cover 102*b* of the document pressing cover 102 are formed integrally by plastic materials so as to function also as the outer guide member, a number of components can be reduced and an assembling process can be carried out easily. The configuration of the transportation path 3 is one example and can be changed into a configuration of a known transportation path without departing from the scope of the present invention. For example, instead of the paper guide 30, a transportation drum having a large diameter can be provided.

A transportation roller 5 is formed by a plurality of roller bodies fixed on a roller shaft in an axial direction at a prescribed interval between one another. For example, roller bodies made of silicon or Ethylene-Propylene-Diene Methylene linkage (EPDM) are fixed on a metal roller shaft. A number and positions of the roller bodies are set appropriately according to, for example, a size of an original document to be transported. The transportation rollers 5 are disposed in the paper guide 30 which constitutes the inner guide surface. In the outer guide surface, driven rollers 50 are disposed facing the transportation rollers 5. An original document is transported along the transportation path 3 by being nipped by the transportation rollers 5 and the driven rollers 50. In the same manner as the transportation rollers 5 and the driven rollers 50, at an outlet of the transportation path 3, document discharge rollers 51 are provided. The original document is transported out from the transportation path 3 onto the document discharge tray 4 by the document discharge rollers 51. Further, in the above-described example, a plurality of transportation rollers 5 and the driven rollers 50 are provided along the transportation path 3. However, the above-described example is just one example. A number and positions of the transportation rollers 5 or the like are set appropriately according to a shape or a distance of the transportation path 3.

The CIS scanning unit 13 uses a CIS. Although details are not shown in the drawing, the CIS scanning unit 13 is a stationary typed scanning unit which focuses the reflected light from the original document irradiated by the light source onto a photoconductive element by a focusing fiber and carries out a scanning process. The CIS scanning unit 13 is provided facing the CCD scanning unit 12 across the transportation path 3 and downstream of the transportation path 3. Accordingly, an image on the reverse side of the original document is scanned. In general, the CIS adopted in the CIS scanning unit 13 has a narrow subject depth. Therefore, an image scanning process is carried out under a state in which the original document is nipped by a platen roller 19. Further, the platen roller 19 is provided facing the CIS scanning unit 13 across the transportation path 3.

Figure 3:
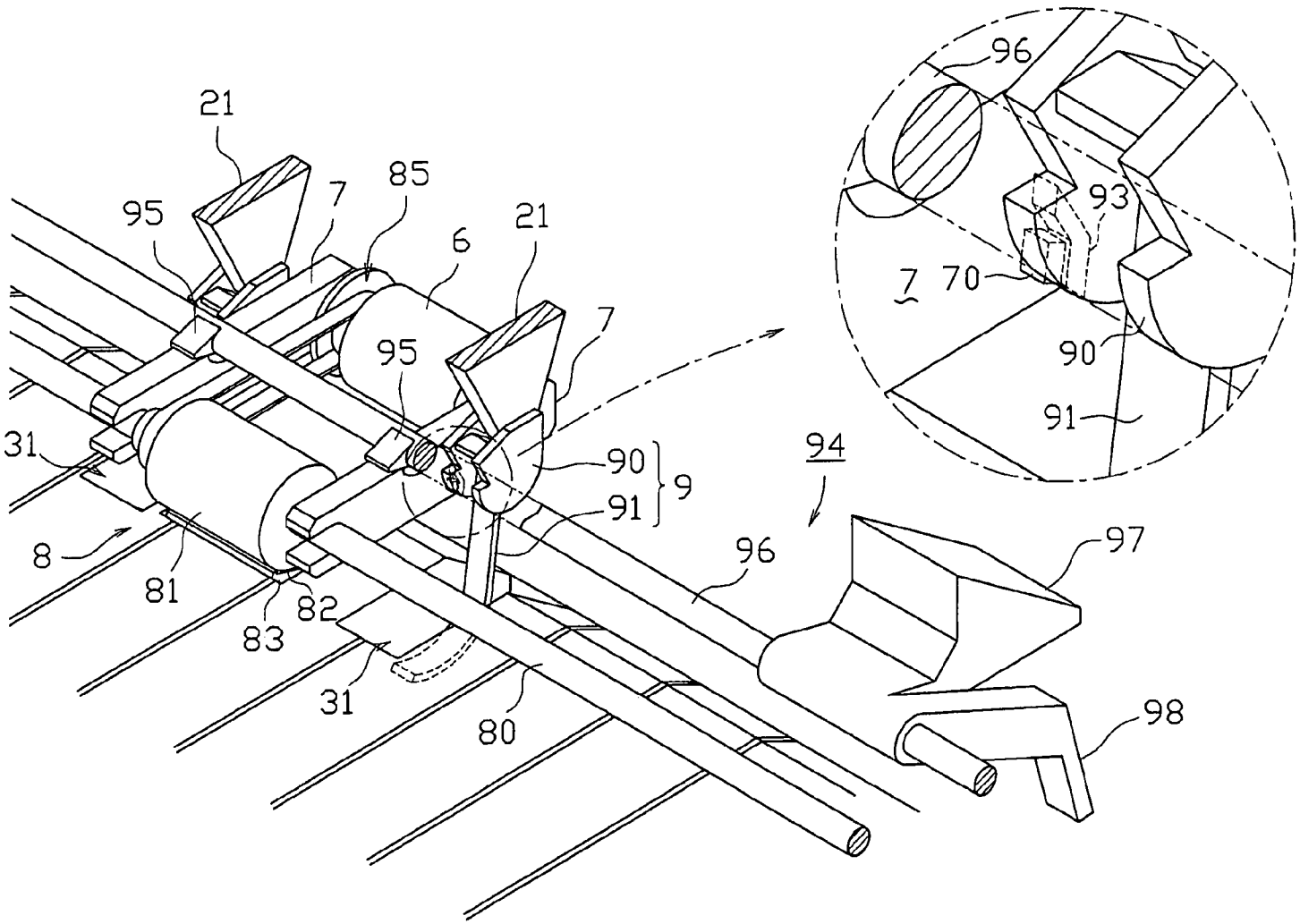
FIG. 3 is an enlarged perspective view showing a configuration in proximity to a shutter 9.
Figure 4:
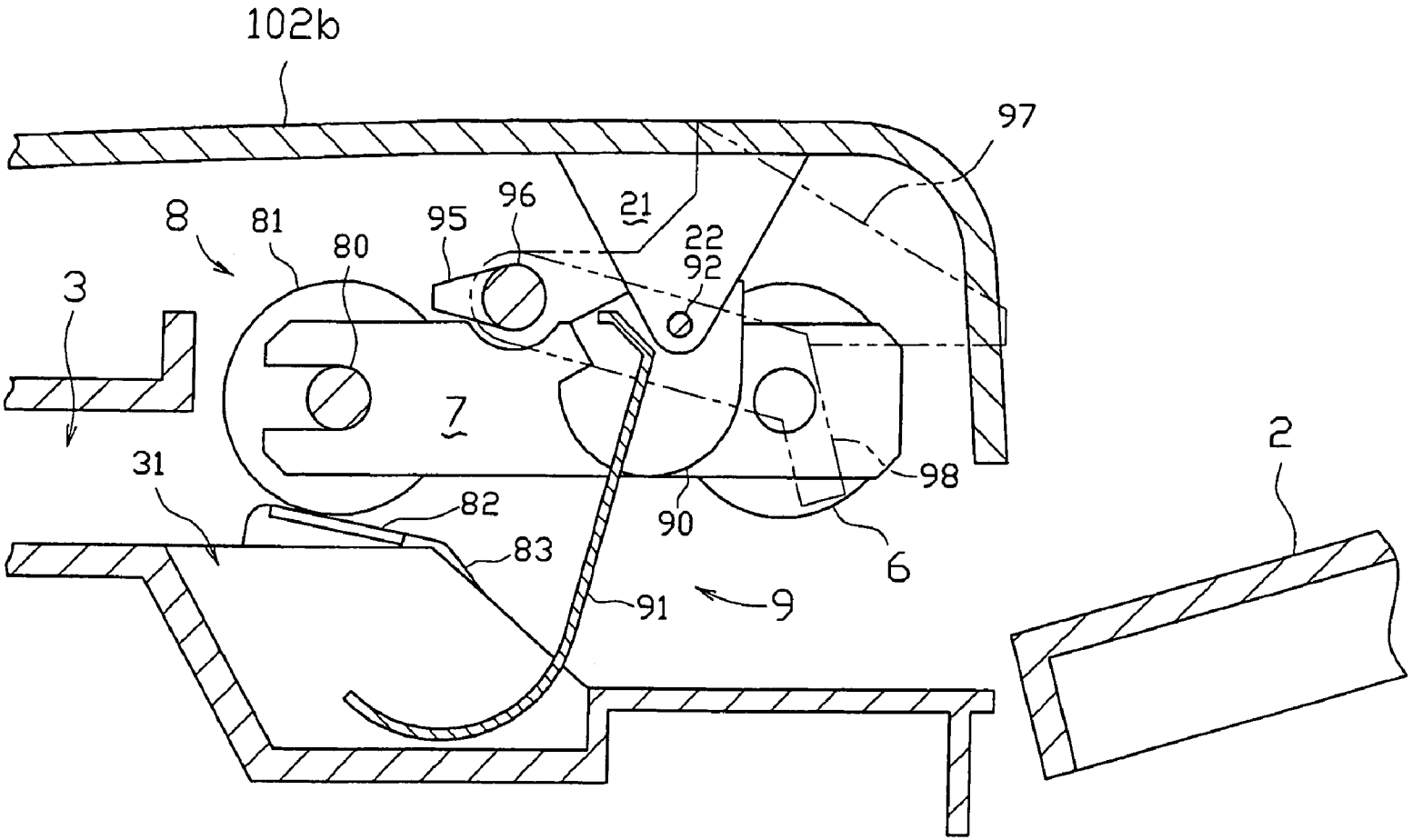
FIG. 4 is a partial enlarged cross-sectional view showing the configuration of the shutter 9.

As shown in FIG. 3 and FIG. 4, the pickup roller 6 is provided in proximity to the inlet of the transportation path 3. The pickup roller 6 rotates while making contact with the original document on the document tray 2, and feeds the original document into the transportation path 3. The pickup roller 6 is supported rotatably by the pickup arms 7 which are swung vertically by a document feed clutch (not shown). Further, for convenience of indicating by drawing, in FIG. 3, the top plate part of the ADF cover 102*b* is omitted. The pickup arms 7 are a pair of arms which sandwich the pickup roller 6 rotatably. A base end of the pickup arms 7 are held rotatably on a roller shaft 80 of the document feed roller 8 with the roller shaft 80 as the center of the swing. A tip end of the pickup arms 7 extend toward the document tray 2, in other words, toward the upstream side. The tip end of the pickup arms 7 support the pickup roller 6. Under the standby state when the original document is placed onto the document tray 2, the tip end of the pickup arms 7 elevate and the pickup roller 6 separates from the inner guide surface of the transportation path 3. When picking up the original document, the tip end of the pickup arms 7 descend so that the pickup roller 6 descends to make contact with an uppermost sheet of the original documents on the document tray 2. Further, the pickup roller 6 can descend until making contact with the inner guide surface of the transportation path 3. Therefore, even when a thickness of a bundle of the original documents changes due to a number of the original documents, the pickup roller 6 can make contact with the uppermost sheet at all times.

The document feed roller 8 is disposed to the downstream of the pickup roller 6. The document feed roller 8 rotates while making contact with the original document fed from the document tray 2 and feeds the original document into the transportation path 3. A roller body 81 made of silicon or EPDM is mounted on the metal roller shaft 80 via a one-way clutch (not shown). Meanwhile, a separating pad 82 is provided below the document feed roller 8. A coefficient of friction of the separating pad 82 with respect to the original document is lower than a coefficient of friction of the roller body 81 with respect to the original document and higher than a coefficient of friction between the original documents. For example, the separating pad 82 can be formed by urethane resin. The separating pad 82 is adhered on an upper surface of a separating pad holder 83. As shown in FIG. 2, the separating pad holder 83 is fit in the inner guide surface of the transportation path 3 in a manner capable of being rocked. The separating pad holder 83 is urged upward by a coil spring 84. Accordingly, the separating pad 82 makes contact with the roller body 81 of the document feed roller 8 and can be swung downward according to the thickness of the original document that passes through the contact portion. The original documents fed into the transportation path 3 by the pickup roller 6 are separated one sheet at a time by the document feed roller 8 and the separating pad 82. Then, each original document is transported into the transportation path 3. The original document transported into the transportation path 3 is nipped by the transportation rollers 5 and the driven rollers 50 and transported to the scanning positions P1 and P2. When the original document is nipped by the transportation rollers 5 and the driven rollers 50, the roller body 81 of the document feed roller 8 becomes rotatable in the document transportation direction with respect to the roller shaft 80 by the one-way clutch. Accordingly, the rotation of the roller body 81 follows the original document transported by the transportation rollers 5 so that the transportation of the original document is not influenced by the nip of the document feed roller 8 and the separating pad 82. As a result, a vibration of the original document is not generated at the scanning position P1 or the like.

Although not shown in the drawing, the presence or the absence of an original document at the document tray 2 is detected by a document set sensor. In accordance with a detection signal, a control unit controls a movement of the pickup roller 6, the pickup arms 7, the document feed roller 8 and a document feed clutch (not shown) (refer to FIG. 10). A drive force from a drive source such as a motor is transmitted to the roller shaft 80 of the document feed roller 8. The drive force is further transmitted to a roller shaft of the pickup roller 6 by a belt transmitting mechanism 85. In addition, when lowering the pickup arms 7, the document feed clutch is engaged and the drive force is also transmitted to the pickup arms 7. By the pickup roller 6 and the document feed roller 8 being rotated, an uppermost sheet of the original documents is separated one sheet at a time and fed into the transportation path 3. The pickup arms 7 are urged upward by a spring. When the document feed clutch is disengaged, the pickup arms 7 return to an uppermost position by the urging force of the spring and becomes under the standby state.

The shutter 9 is suspended from the ADF cover 102*b* under a freely swinging state at the upstream of the document feed roller 8. In detail, as shown in FIG. 3 and FIG. 4, the shutter 9 includes a base 90 and a regulatory piece 91. A spindle 92 is provided through the base 90 for suspending the shutter 9. Meanwhile, brackets 21 are provided on the ADF cover 102*b* so as to sandwich the pickup arms 7. The spindle 92 is inserted through shaft holes 22 formed through each of the brackets 21. At both sides of the pickup arms 7, a pair of shutters 9 are suspended from the ADF cover 102*b* under a freely swinging state, respectively. The regulatory piece 91 extends downward from the base 90 to a concave recess 31 formed on the inner guide surface of the transportation path 3. The regulatory piece 91 is formed in a plate shape. A tip end part of the regulatory piece 91 is curved toward the downstream side. The concave recess 31 is formed so as to not interfere with the swing of the regulatory piece 91 at a naturally suspended position under a state in which the regulatory piece 91 crosses the transportation path 3 in the vertical direction. Further, the naturally suspended position is a position where the shutter 9 of the freely swinging state stops naturally under a state in which the ADF cover 102*b* is closed. Accordingly, when the shutter 9 swings from the naturally suspended position to the downstream side, the shutter 9 does not make contact with the inner guide surface of the transportation path 3.

Figure 5:
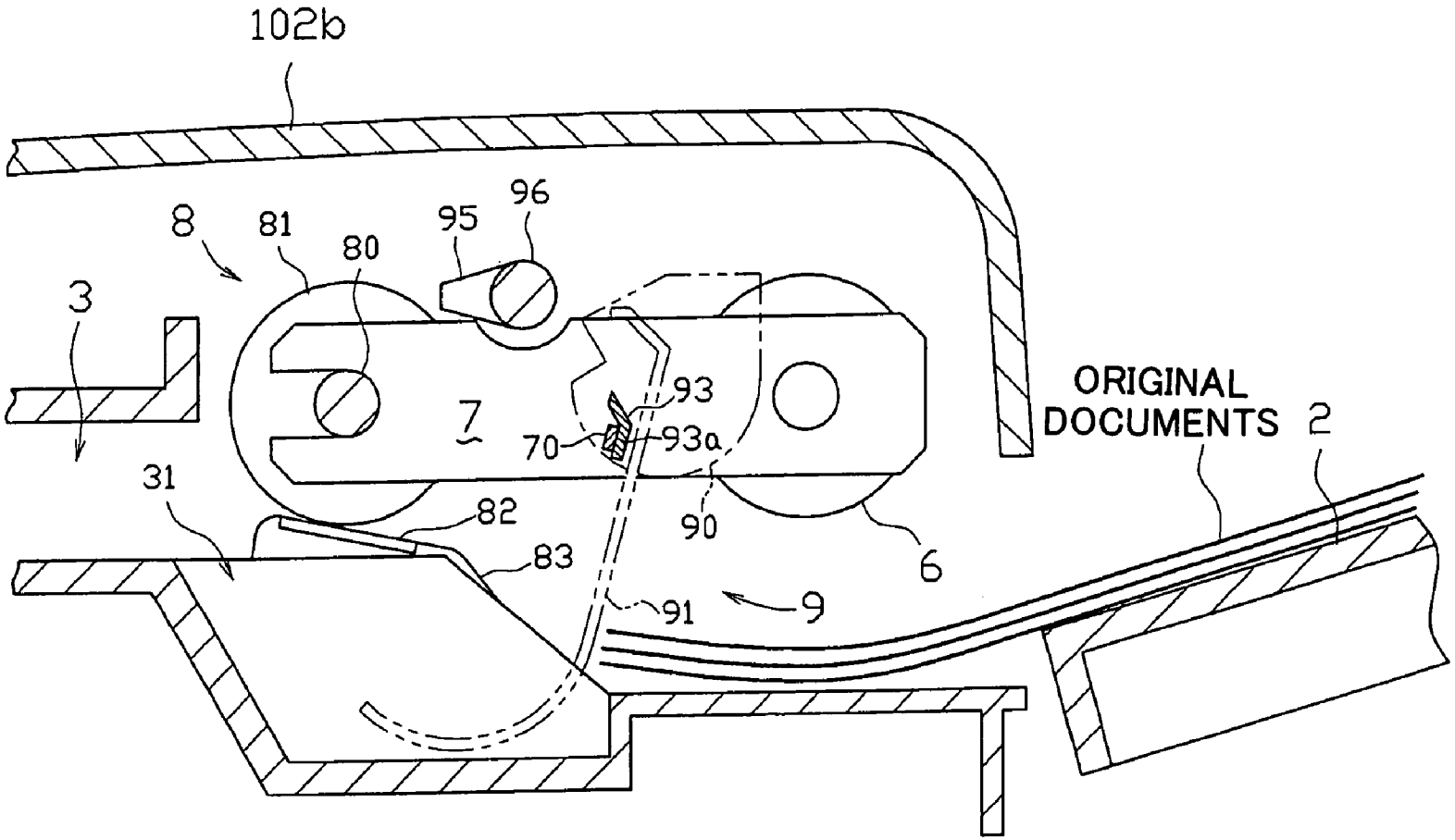
FIG. 5 is a partial enlarged cross-sectional view showing a configuration of a stopper 70 and a receiver 93.

As shown in FIG. 3 and FIG. 5, stoppers 70 are provided protruding from both sidewalls of the pickup arms 7, respectively. A receiver 93 is provided in the sidewall of the bases 90 of each shutter 9, respectively. The receiver 93 makes contact with the stopper 70 in the direction in which the shutter 9 swings. The receiver 93 does not make contact with the stopper 70 downstream of the direction in which the pickup arm 7 swings. In detail, the stopper 70 is a protrusion piece of an approximately rectangular parallelepiped. The receiver 93 makes contact with the stopper 70 of the pickup arm 7 under the standby state at a contact surface 93*a*. The contact surface 93*a* is approximately orthogonal to the direction in which the shutter 9 swings. The stopper 70 and the receiver 93 are provided so that with respect to the swing of the shutter 9, the contact position of the stopper 70 and the receiver 93 is located to the center of the swing of the ADF cover 102*b* other than the naturally suspended position of the shutter 9, in other words, at a position located downstream in the document transportation direction other than the naturally suspended position of the shutter 9, so that at the contact position, the regulatory piece 91 of the shutter 9 crosses the transportation path 3. Accordingly, from the state in which the regulatory piece 91 shuts the transportation path 3, the regulatory piece 91 is prohibited from swinging toward the downstream side. As a result, the position where the leading edges of the original documents placed on the document tray 2 enter into the transportation path 3 is regulated by the regulatory piece 91.

Figure 6:
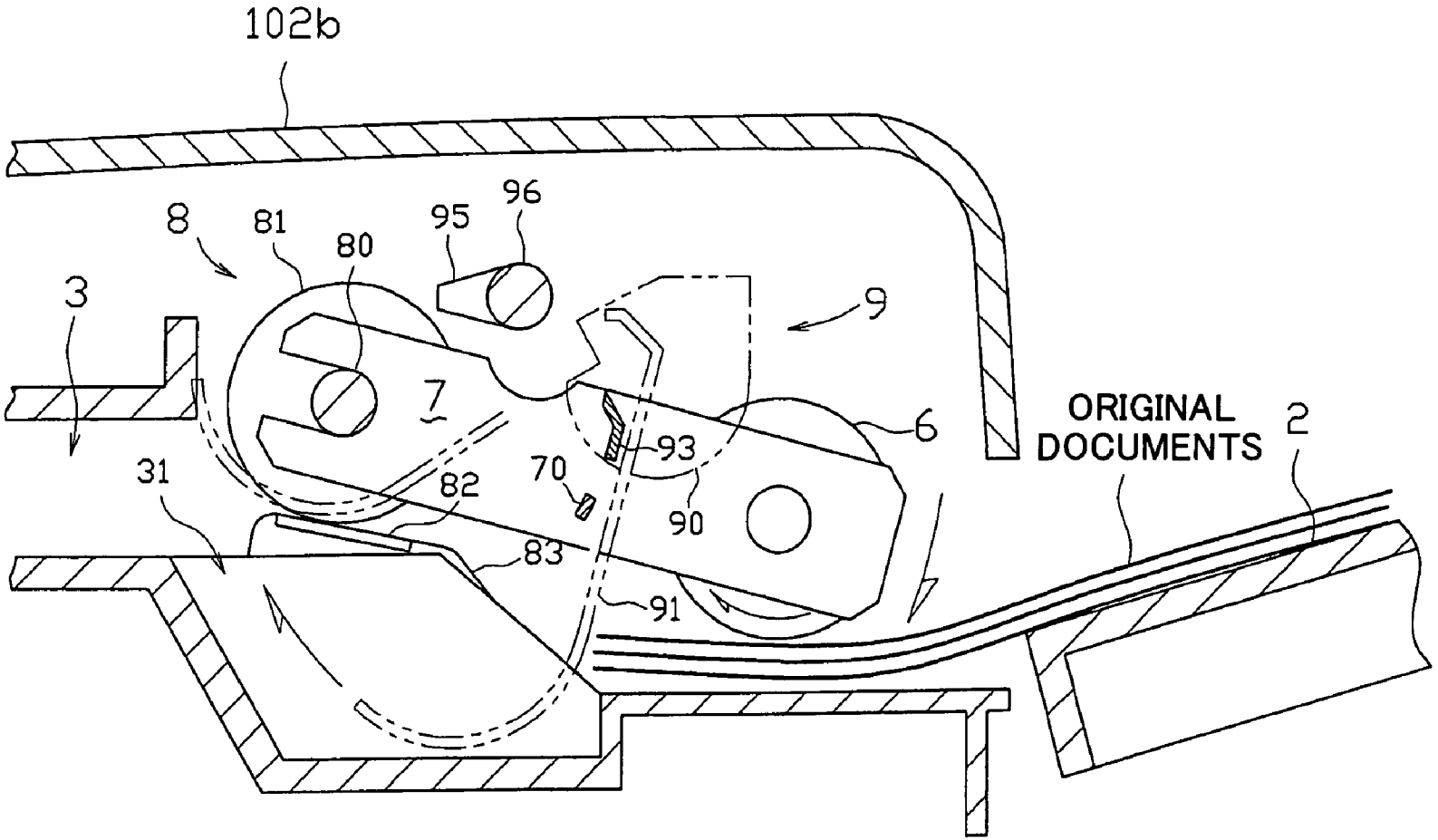
FIG. 6 is a partial enlarged cross-sectional view showing a state of the shutter 9 when feeding an original document.

Meanwhile, under the state in which the contact surface 93*a* makes contact with the stopper 70, the receiver 93 does not make contact with the stopper 70 downstream of the direction in which the pickup arm 7 swings. Accordingly, under the state in which the stopper 70 makes contact with the receiver 93 and prohibits the swing of the shutter 9, the stopper 70 and the receiver 93 do not interfere with a direction in which the pickup arm 7 makes contact with the original document. In other words, the stopper 70 and the receiver 93 do not interfere with the downward swing of the pickup arm 7. As shown in FIG. 6, from the state in which the stopper 70 and the receiver 93 are making contact with one another, in other words, from the state in which the shutter 9 is stopped by the stopper 70, for feeding the original documents placed on the document tray 2 into the transportation path 3, the pickup arm 7 swings downward and the stopper 70 also moves downward. Accordingly, the stopper 70 separates from the receiver 93 and the stopped state of the shutter 9 is released. Therefore, the original documents fed into the transportation path 3 by the pickup roller 6 push aside the regulatory piece 91 of the shutter 9 under the freely swinging state and enter into the transportation path 3. In this case, an upper surface of the original documents entering the transportation path 3 makes contact with the regulatory piece 91. However, since the tip end part of the regulatory piece 91 is curved, the original documents are not damaged by the regulatory piece 91. The original documents fed into the transportation path 3 are separated one sheet at a time by the document feed roller 8 and the separating pad 82 and transported further through the transportation path 3. Under the standby state of the pickup arm 7, the transportation path 3 is shut by the shutter 9 upstream of the document feed roller 8. As a result, the leading edges of the original documents placed on the document tray 2 are prevented from colliding against the document feed roller 8 and being damaged. In addition, the original documents are prevented from being caught between the document feed roller 8 and the separating pad 82 and a multi-feeding of the original documents is prevented. When the pickup arm 7 swings downward for picking up the original documents, the shutter 9 becomes under the freely swinging state and the original documents can pass through the transportation path 3.

Figure 7:
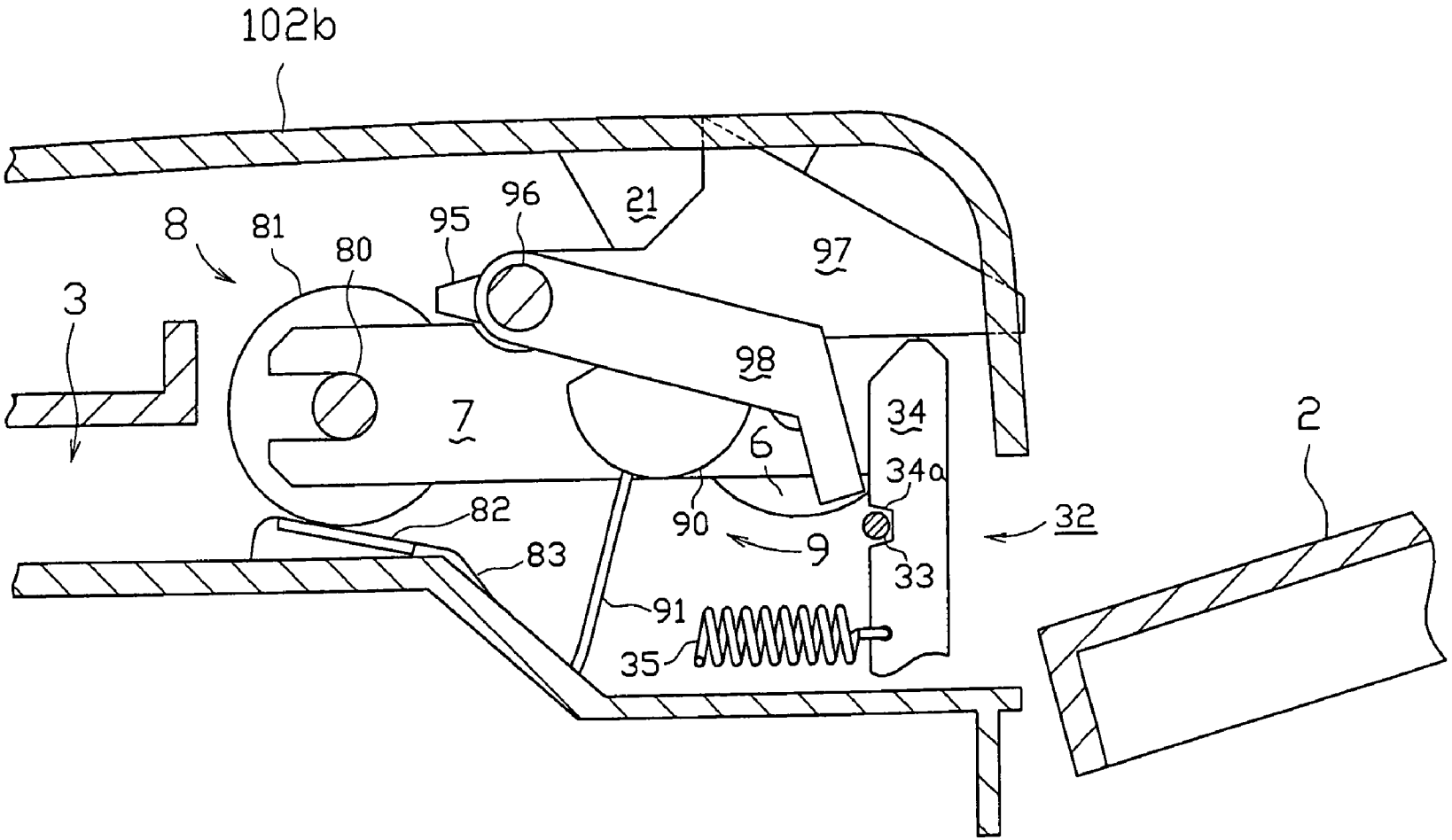
FIG. 7 is a partial enlarged cross-sectional view showing a configuration of a shutter releasing mechanism 94 and a lock mechanism 32.

Next, a shutter releasing mechanism 94 for releasing the stopped state of the shutter 9 when opening the ADF cover 102*b* of the document pressing cover 102 will be described. As shown in FIG. 3 and FIG. 7, the shutter releasing mechanism 94 includes a shaft 96 and an operation knob 97. The shaft 96 has protrusions 95 for swinging the pickup arms 7 in the direction to make contact with the original document, in other words, in a downward direction. The operation knob 97 is provided for rotating the shaft 96. The shaft 96 is provided directly above the pickup arms 7, in the same direction as the roller shaft 80 of the document feed roller 8. The protrusions 95 protrude radially from a circumferential surface of the shaft 96 at positions corresponding to the pair of the pickup arms 7. Under a normal state, the protrusions 95 are located away from the pickup arms 7 under the standby state. When the shaft 96 rotates, the protrusions 95 respectively make contact with the upper surface of the pickup arms 7. When the shaft 96 rotates further, the pickup arms 7 are pushed and swung downward. As described above, under the standby state, the document feed clutch is disengaged and the pickup arms 7 are located at an uppermost position by the urging force of the spring. Therefore, if the shaft 96 is rotated against the urging force of the spring, the pickup arms 7 can be swung downward via the protrusions 95.

The operation knob 97 is provided so that the user can easily swing the shaft 96. The shaft 96 can be provided at any position. However, as shown in FIG. 3, in terms of operationality, the operation knob 97 is preferable to be provided extending from the shaft 96 toward the upstream side at the front side of the automatic document transportation device 1. By the above-described shutter releasing mechanism 94, the user can lift the operation knob 97 upward to rotate the shaft 96. Then, as described above, the pickup arms 7 under the standby state can be swung downward manually via the protrusions 95. Although not shown in the drawing, the operation knob 97 is urged by a spring or the like to return to the normal state after the operation. Accordingly, under the normal state in which the operation knob 97 is not operated, the protrusions 95 are located away from the pickup arms 7.

Next, a lock mechanism 32 which locks the swing of the ADF cover 102*b* under a state in which the ADF cover 102*b* is covering the cover frame 102*a* will be described. As shown in FIG. 7, the lock mechanism 32 includes a lock pin 33, a lock arm 34, a coil spring 35 and a lock releasing arm 98. The lock pin 33 is provided on the ADF cover 102*b*. The lock arm 34 slants to be engaged with the lock pin 33. The coil spring 35 urges the lock arm 34 in a direction to be engaged with the lock pin 33. The lock releasing arm 98 slants the lock arm 34. The lock pin 33 protrudes in the horizontal direction from the inner wall of the ADF cover 102*b*. By being engaged with a cutout 34*a* formed on the lock arm 34, the lock pin 33 restricts the upward swing of the ADF cover 102*b*. Meanwhile, the lock arm 34 is provided in a standing condition at a position corresponding with the lock pin 33 at the cover frame 102*a*. Although details are not shown in the drawing, the lock arm 34 can be slanted to the upstream side with the lower end of the lock arm 34 as an axis. Furthermore, the lock arm 34 is connected to the coil spring 35 which one end is fixed on a certain position of the cover frame 102*a*. Accordingly, the lock arm 34 is provided in a standing condition at all times by being urged to the downstream side. Therefore, under the state in which the ADF cover 102*a* is closed, when an external force is not applied to the lock arm 34, the lock pin 33 and the lock arm 34 are engaged. The lock releasing arm 98 is formed integrally with the operation knob 97. The lock releasing arm 98 extends from the shaft 96 to the proximity of the lock arm 34. When the operation knob 97 is pulled upward, the lock releasing arm 98 swings upward with the shaft 96 as an axis and slants the lock arm 34. By the above-described lock mechanism 32, the ADF cover 102*b* is locked under a state in which the ADF cover 102*b* is covering the upper part of the cover frame 102*a*. When carrying out maintenance work or removing a jammed paper, the lock arm 34 is slanted against the urging force of the coil spring 35 by the lock releasing arm 98. Accordingly, the lock pin 33 and the lock arm 34 are disengaged and the ADF cover 102*b* can be swung. Further, the above-described configuration of the lock mechanism 32 is just an embodiment of the present invention. The lock mechanism 32 can be changed to other known lock mechanisms without departing from the scope of the present invention.

Figure 8A:
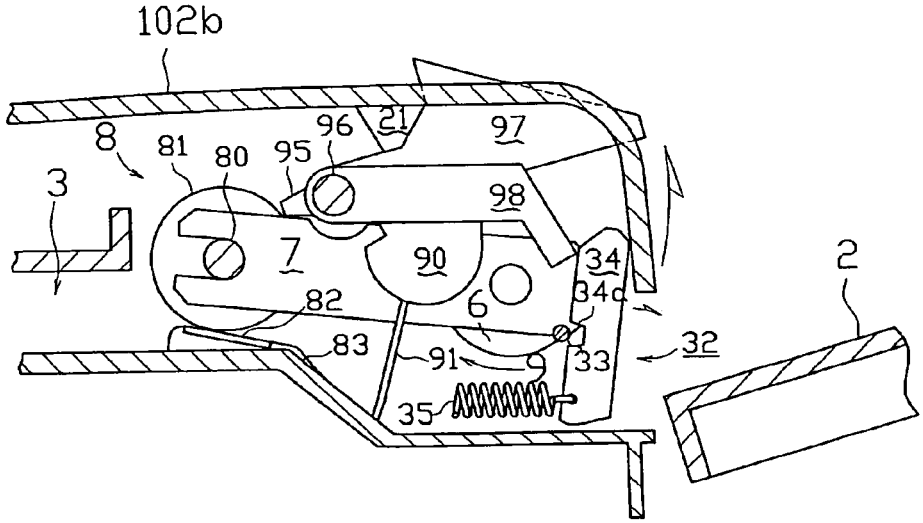
FIG. 8A is a partial enlarged cross-sectional view showing a state in which an operation knob 97 is pulled upward.
Figure 8B:
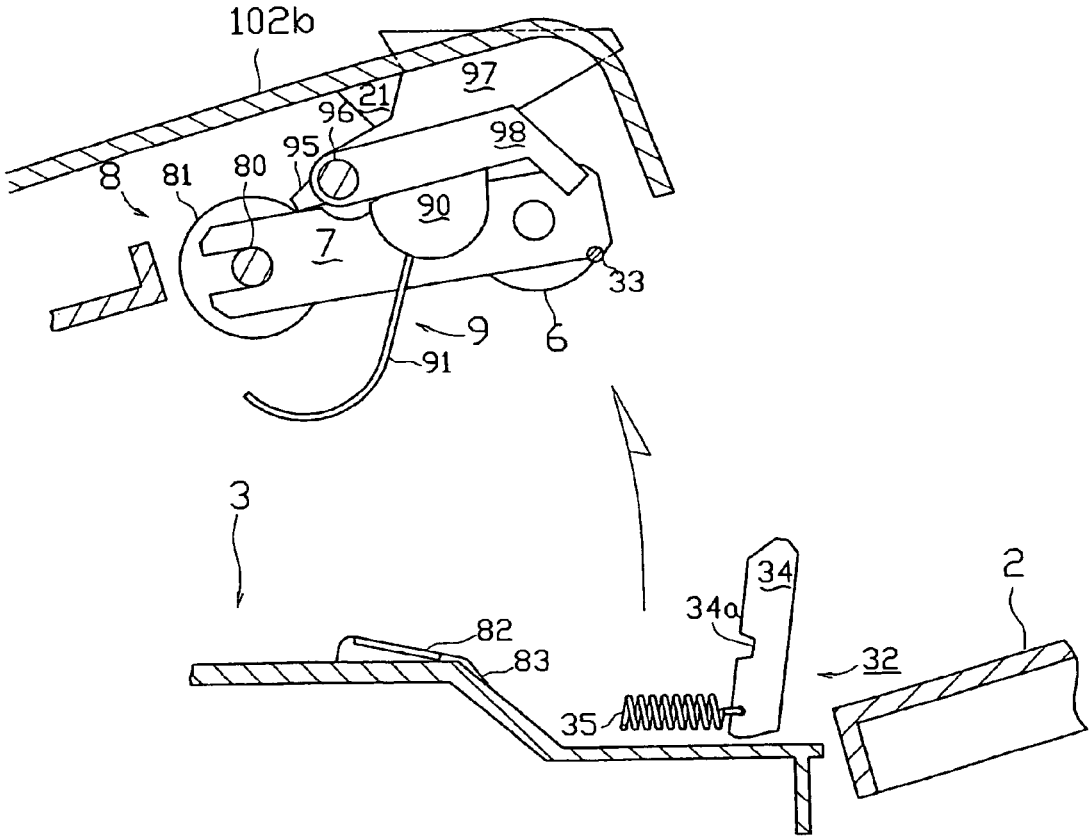
FIG. 8B is a partial enlarged cross-sectional view showing a state in which an ADF cover 102*b* is opened.

Next, the operation of the shutter releasing mechanism 94 and the lock mechanism 32 when opening and closing the ADF cover 102*b* will be described. When opening the ADF cover 102*b*, by pulling the operation knob 97 upward, the shaft 96 rotates and the protrusions 95 push the pickup arms 7 downward. Accordingly, as shown in FIG. 6, the stopped state of the shutter 9 by the stopper 70 is released. Meanwhile, when the operation knob 97 is pulled upward, the lock releasing arm 98 also swings upward with the shaft 96 as the axis and the tip end of the lock releasing arm 98 slants the lock arm 33 to the upstream side. Accordingly, as shown in FIG. 8A, the engagement of the lock pin 33 and the cutout 34*a* of the lock arm 34 are disengaged. Then, as shown in FIG. 8B, the ADF cover 102*b* can be opened upward.

Figure 9A:
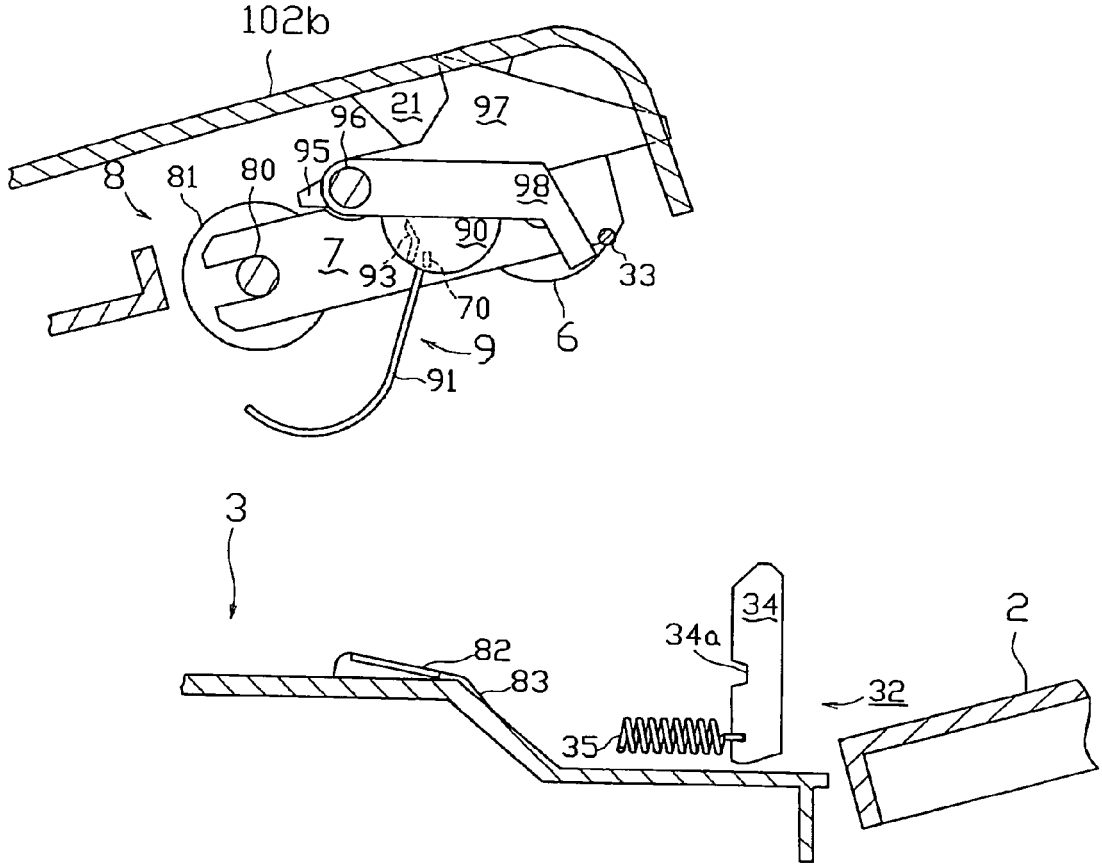
FIG. 9A is a partial enlarged cross-sectional view showing the stopper 70 and the receiver 93 under the state in which the ADF cover 102*b* is opened.

Under a state in which the stop of the shutter 9 by the stopper 70 is released, by opening the ADF cover 102*b* upward, the shutter 9 under the freely swinging state swings naturally toward the center of the swing of the ADF cover 102*b*, in other words, toward the downstream side, by gravitation. Therefore, when the operation knob 97 is released thereafter, the operation knob 97 returns to the normal state by the spring or the like and the protrusions 97 also return to the normal state. Accordingly, the pickup arms 7 become under the standby state. However, as shown in FIG. 9A, by opening the ADF cover 102*b*, the receiver 93 of the shutter 9 is moved toward the center of the swing other than the stopper 70. Therefore, the shutter 9 is restricted from swinging toward the upstream side by the stopper 70 and does not return to the stopped state. Thus, when closing the ADF cover 102*b*, even in case the shutter 9 makes contact with the original document located on the inner guide surface in proximity to the inlet of the transportation path 3, since the shutter 9 swings to escape toward the downstream side, the original document is not damaged.

Figure 9B:
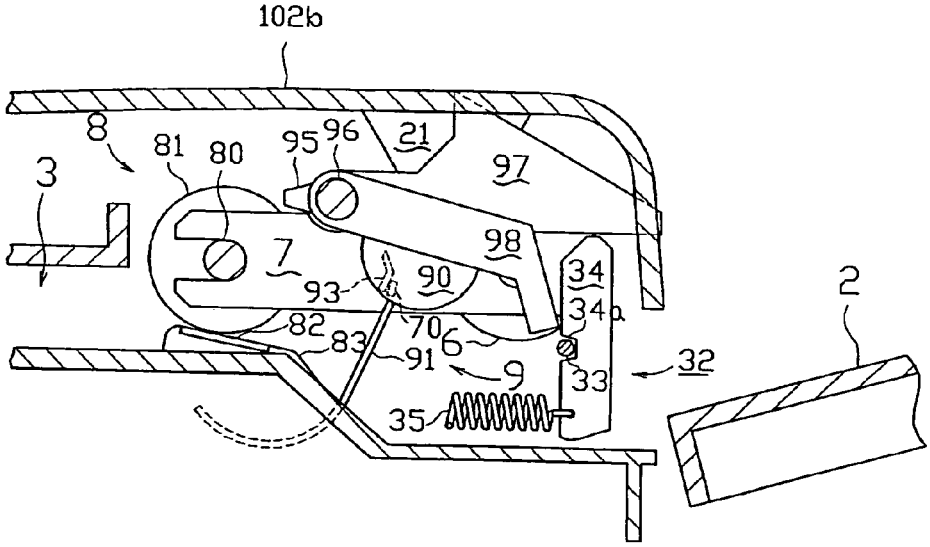
FIG. 9B is a partial enlarged cross-sectional view showing the stopper 70 and the receiver 93 after the ADF cover 102*b* is opened or closed.

Meanwhile, in case the ADF cover 102*b* is opened and closed, for example, when the original document is not placed on the document tray 2, in preparation for an original document to be placed on the document tray 2 later, it is necessary to return the shutter 9 to the stopped state after closing the ADF cover 102*b*. As described above, after the ADF cover 102*b* is opened, as shown in FIG. 9B, the receiver 93 of the shutter 9 is still located to the center of the swing other than the stopper 70. Therefore, when closing the ADF cover 102*b* or after closing the ADF cover 102*b*, the operation knob 97 can be pulled upward once and the pickup arms 7 can be swung downward. Accordingly, by gravitation, the shutter 9 returns to the naturally suspended position. Then, by returning the operation knob 97 to the normal state, the shutter 9 can be stopped by the stopper 70. However, by controlling the swing of the pickup arms 7 as to be described below, the shutter 9 can be returned automatically to the stopped state after opening and closing the ADF cover 102*b*.

Figure 10:
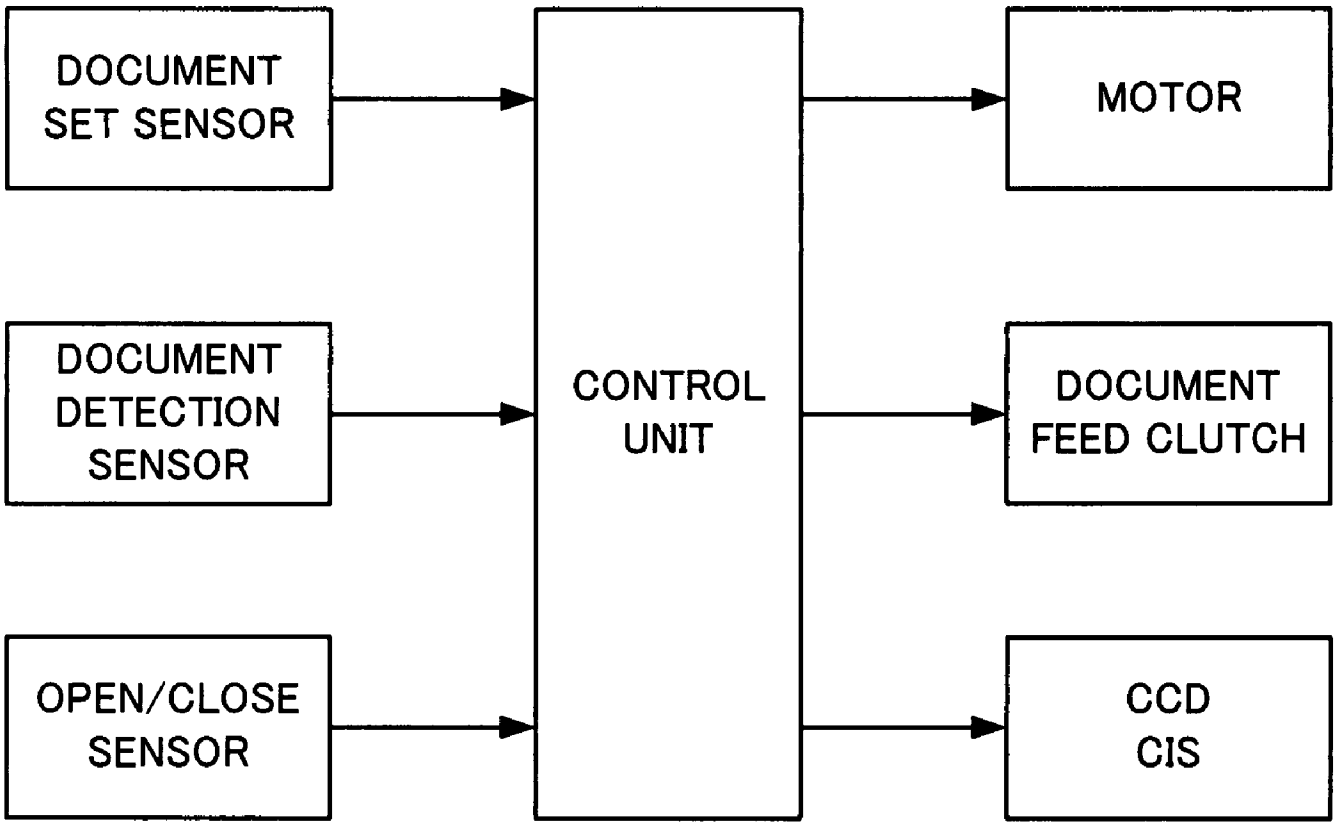
FIG. 10 is a block diagram showing an example of a control mechanism.
Figure 11:
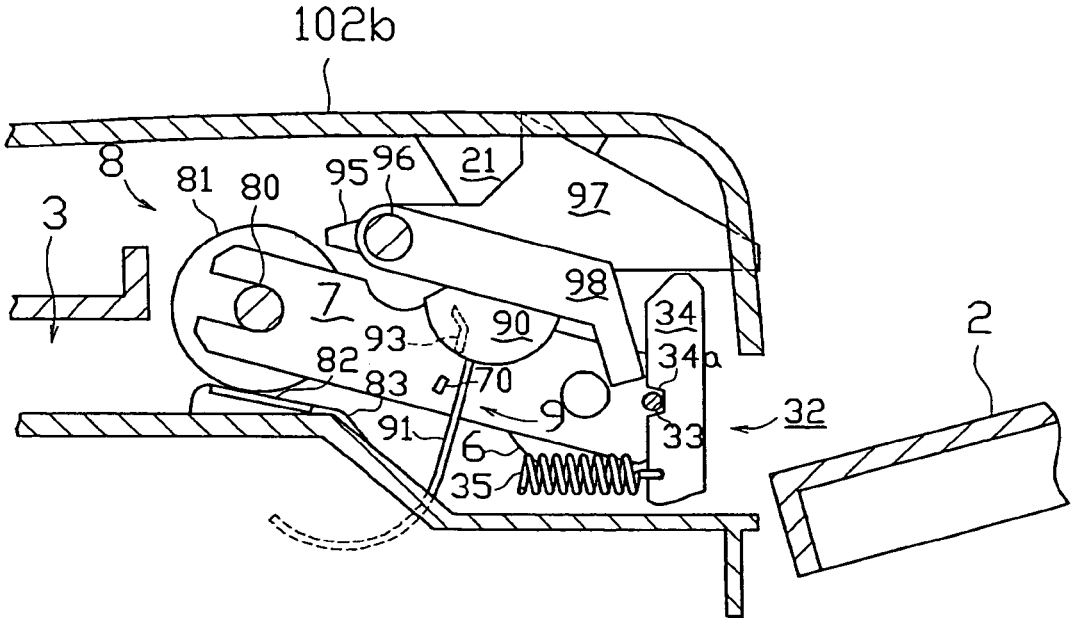
FIG. 11 is a partial enlarged cross-sectional view showing a state in which a pickup arm 7 is swung automatically by a control of a control unit.
Figure 12:
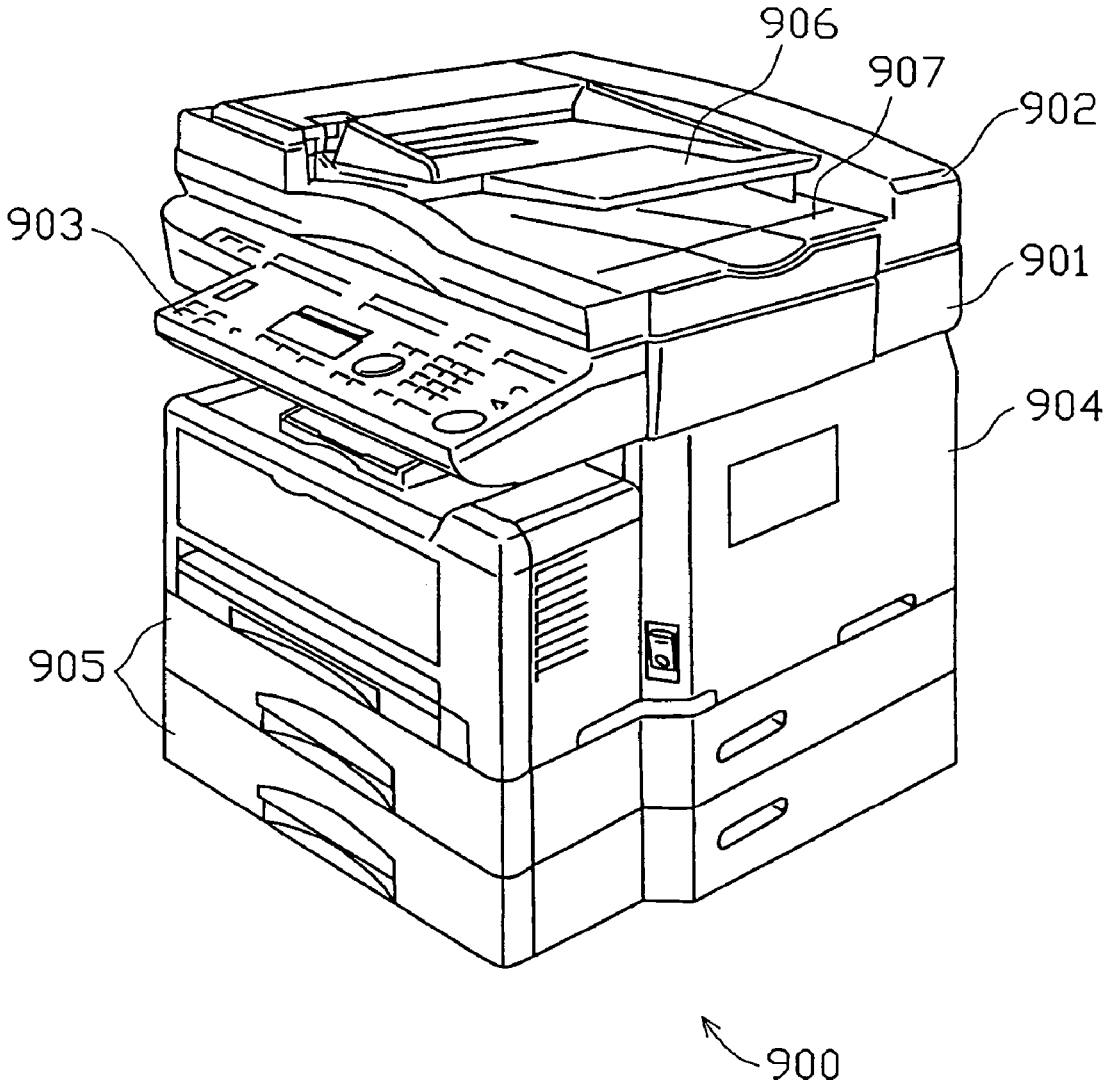
FIG. 12 is a perspective view showing an exterior configuration of a conventional copy-and-facsimile MFP 900.
Figure 13:
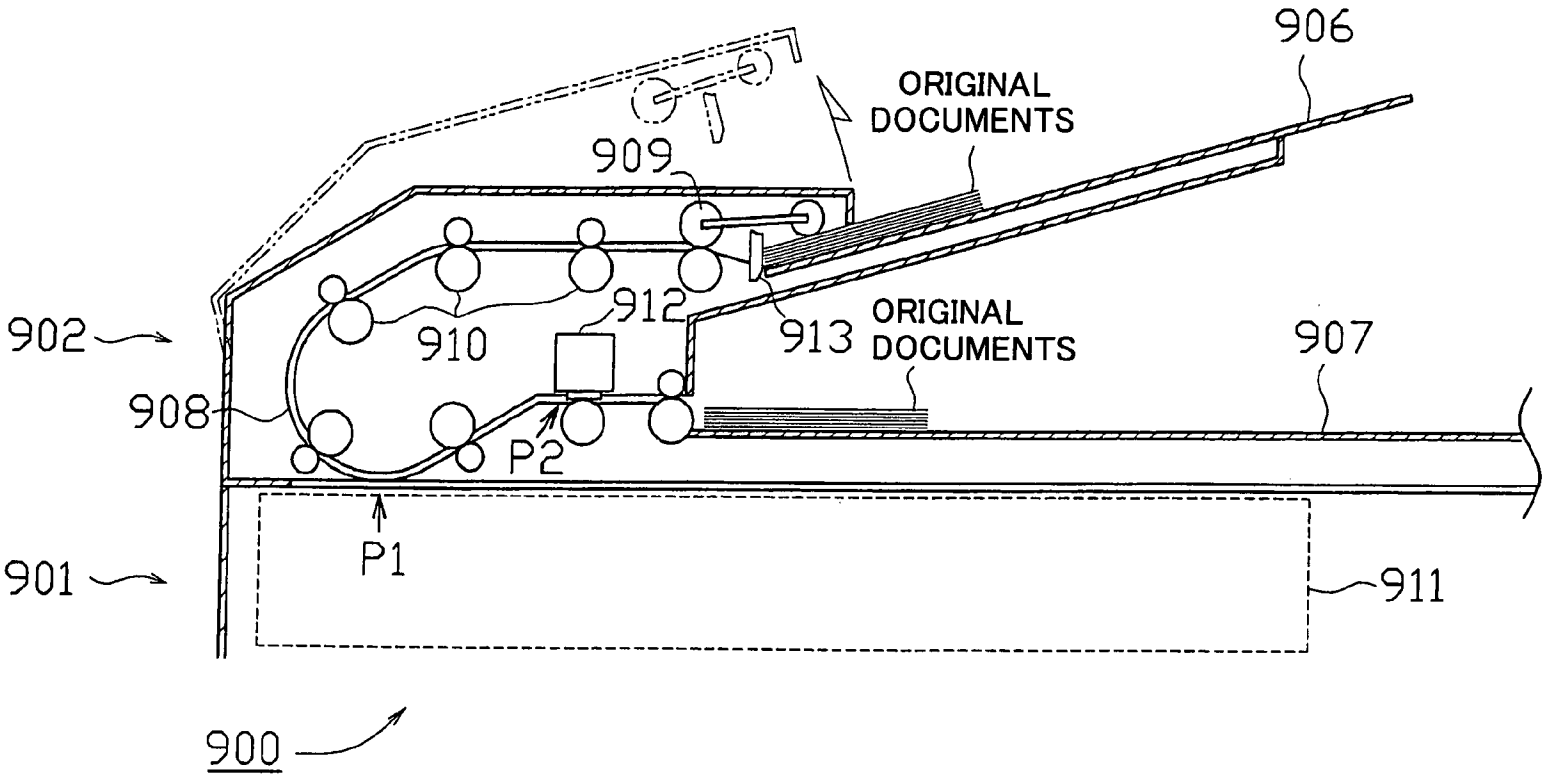
FIG. 13 is a cross-sectional view showing a schematic configuration of an upper part of the copy-and-facsimile MFP 900.

As shown in FIG. 10, the automatic document transportation device 1 includes an open/close sensor and a control unit. The open/close sensor detects an opened or closed state of the ADF cover 102*b*. The control unit receives a signal from the open/close sensor indicating that the ADF cover 102*b* has been switched from the opened state into the closed state. Then, the control unit controls a motor and a document feed clutch so as to return the pickup arms 7 to the standby state after swinging the pickup arms 7 in the direction to make contact with the original document, in other words, downward. A position of the open/close sensor is not limited specifically. The control unit can be shared with the control unit which receives a signal from the document set sensor or a document detection sensor when transporting the original document and controls the motor, the document feed clutch, the CCD scanning unit 12, the CIS scanning unit 13 or the like. Further, the document detection sensor is provided on the transportation path 3 at a position located upstream of the scanning position P1. By such a control mechanism, the control unit receives a signal from the open/close sensor indicating that ADF cover 102*b* has been switched from the opened state to the closed state. Then, the control unit engages the document feed clutch and drives the motor to operate the pickup arms 7 once in the direction to make contact with the original document. Accordingly, as shown in FIG. 11, the shutter 9 becomes under the freely swinging state, and by gravitation, the shutter 9 moves to the naturally suspended position. Then, by returning the pickup arms 7 to the standby state, as shown in FIG. 5, the swing of the shutter 9 to the downstream side is stopped by the stopper 70 and the shutter 9 returns to the stopped state. Therefore, after opening or closing the ADF cover 102*b*, it is not necessary to operate the operation knob 97 manually. When this operation is forgotten to be carried out and the shutter 9 does not restrict the entering position of the original document, the original document is damaged or a multi-feeding of the original documents is generated. However, such drawbacks can also be prevented.

Further, the configuration of the copy-and-facsimile MFP 100 described in the above embodiment is just one example of the automatic document transportation device of the present invention. Without departing from the scope of the present invention, the configuration of the copy-and-facsimile MFP 100 can be changed accordingly. For example, the present invention can be applied to a device having a single function such as a copy machine, a facsimile machine and a scanner. The copy-and-facsimile MFP 100 can be formed as a machine for scanning a single side of the original documents and the CIS scanning unit 13 can be omitted.

What is claimed is:

1. An automatic document transportation device, comprising:

a document tray on which an original document before a scanning process is placed;

a transportation roller which transports the original document through a transportation path;

a document discharge tray on which the original document after the scanning process is stacked;

a pickup roller which picks up the original document placed on the document tray;

a pickup arm which supports the pickup roller in a manner that the pickup roller makes contact with or separates from the original document placed on the document tray;

a document feed roller which feeds the picked up original document into the transportation path;

a cover which is provided on an upper part of a main frame in a manner capable of being swung;

a shutter which is provided upstream of the document feed roller and suspended from the cover under a freely swinging state;

a stopper which is provided on the pickup arm, stops the swing of the shutter so that the shutter restricts a position of a leading edge of the original document on the document tray when the pickup arm is under a standby state, and releases the stop of the shutter when the pickup arm operates in a direction to make contact with the original document;

a shutter releasing mechanism which includes a shaft having a protrusion, wherein the protrusion rushes the pickup arm under the standby state in the direction to make contact with the original document when the shaft rotates; and an operation knob for rotating the shaft.

2. The automatic document transportation device according to claim 1, further comprising a lock mechanism which locks a swing of the cover under a state in which the cover is covering the upper part of the main frame, wherein the operation knob rotates the shaft and releases a locked state of the lock mechanism.

3. The automatic document transportation device according to claim 1, wherein the cover is provided in a manner capable of being swung with a downstream side of a document transportation direction as a center of the swing, and the stopper is provided protruding with respect to the swing of the shutter so as to stop the shutter at a position located to the center of the swing of the cover than a naturally suspended position, wherein the automatic document transportation device further comprising:

an open/close sensor which detects an opened or closed state of the cover; and a control unit which receives a signal from the open/close sensor indicating that the cover has been switched from the opened state into the closed state, operates the pickup arm in the direction to make contact with the original document and puts the pickup arm into the standby state.

4. An automatic document transportation device, comprising:

a shutter which is provided upstream of a document feed roller and suspended from a cover under a freely swinging state;

a stopper which is provided on a pickup arm that stops the swing of the shutter so that the shutter restricts a position of a leading edge of an original document when the pickup arm is under a standby state, and releases the stop of the shutter when the pickup arm operates in a direction to make contact with the original document;

a shutter releasing mechanism which includes a shaft having a protrusion, wherein the protrusion gushes the pickup arm under the standby state in the direction to make contact with the original document when the shaft rotates; and an operation knob for rotating the shaft.

5. The automatic document transportation device according to claim 4, further comprising a Lock mechanism which locks a swing of the cover under a state in which the cover is covering an upper part of a main frame wherein the operation knob rotates the shaft and releases a locked state of the lock mechanism.

6. The automatic document transportation device according to claim 4, wherein the cover is provided in a manner capable of being swung with a downstream side of a document transportation direction as a center of the swing, and the stopper is provided protruding with respect to the swing of the shutter so as to stop the shutter at a position located to the center of the swing of the cover than a naturally suspended position, wherein the automatic document transportation device further comprising:

an open/close sensor which detects an opened or closed state of the cover; and a control unit which receives a signal from the open/close sensor indicating that the cover has been switched from the opened state into the closed state, operates the pickup arm in the direction to make contact with the original document and puts the pickup arm into the standby state.

7. The automatic document transportation device according to claim 5, wherein the cover is provided in a manner capable of being swung with a downstream side of a document transportation direction as a center of the swing, and the stopper is provided protruding with respect to the swing of the shutter so as to stop the shutter at a position located to the center of the swing of the cover than a naturally suspended position, wherein the automatic document transportation device further comprising:

an open/close sensor which detects an opened or closed state of the cover; and a control unit which receives a signal from the open/close sensor indicating that the cover has been switched from the opened state into the closed state, operates the pickup arm in the direction to make contact with the original document and puts the pickup arm into the standby state.

8. The automatic document transportation device according to claim 2, wherein the cover is provided in a manner capable of being swung with a downstream side of a document transportation direction as a center of the swing, and the stopper is provided protruding with respect to the swing of the shutter so as to stop the shutter at a position located to the center of the swing of the cover than a naturally suspended position, wherein the automatic document transportation device further comprising:

an open/close sensor which detects an opened or closed state of the cover; and a control unit which receives a signal from the open/close sensor indicating that the cover has been switched from the opened state into the closed state, operates the pickup arm in the direction to make contact with the original document and puts the pickup arm into the standby state.

9. An automatic document transportation device, comprising:

a shutter which is provided upstream of a document feed roller and suspended from a cover under a freely swinging state;

a stopper which is provided on the a pickup arm that stops the swing of the shutter so that the shutter restricts a position of a leading edge of an original document when the pickup arm is under a standby state, and releases the stop of the shutter when the pickup arm operates in a direction to make contact with the original document;

a control unit which includes a shaft having a protrusion, wherein the protrusion pushes the pickup arm under the standby state in the direction to make contact with the original document when the shaft rotates; and an operation knob for rotating the shaft.

10. The automatic document transportation device according to claim 9, further comprising a lock mechanism which locks a swing of the cover under a state in which the cover is covering an upper part of a main frame, wherein the operation knob rotates the shaft and releases a locked state of the lock mechanism.

11. The automatic document transportation device according to claim 10, wherein the cover is provided in a manner capable of being swung with a downstream side of a document transportation direction as a center of the swing, and the stopper is provided protruding with respect to the swing of the shutter so as to stop the shutter at a position located to the center of the swing of the cover than a naturally suspended position, wherein the automatic document transportation device further comprising:

an open/close sensor which detects an opened or closed state of the cover; and a control unit which receives a signal from the open/close sensor indicating that the cover has been switched from the opened state into the closed state, operates the pickup arm in the direction to make contact with the original document and puts the pickup arm into the standby state.

12. The automatic document transportation device according to claim 9, wherein the cover is provided in a manner capable of being swung with a downstream side of a document transportation direction as a center of the swing, and the stopper is provided protruding with respect to the swing of the shutter so as to stop the shutter at a position located to the center of the swing of the cover than a naturally suspended position, wherein the automatic document transportation device further comprising:

an open/close sensor which detects an opened or closed state of the cover; and a control unit which receives a signal from the open/close sensor indicating that the cover has been switched from the opened state into the closed state, operates the pickup arm in the direction to make contact with the original document and puts the pickup arm into the standby state.

* * * * *